US005715993A

United States Patent [19]

Pareike

[11] Patent Number: 5,715,993

[45] Date of Patent: Feb. 10, 1998

[54] FOLDABLE PACKAGE

[75] Inventor: Willi Pareike, Quern, Germany

[73] Assignee: Nordwell GmbH, Flensburg, Germany

[21] Appl. No.: 744,257

[22] Filed: Nov. 6, 1996

[30] Foreign Application Priority Data

Nov. 7, 1995 [EP] European Pat. Off. ..... 95117515

[51] Int. Cl.[6] ..... B65D 5/54

[52] U.S. Cl. ..... 229/125.32; 229/23 BT; 229/123.2

[58] Field of Search ..... 229/23 BT, 123.2, 229/125.32

[56] References Cited

U.S. PATENT DOCUMENTS

| | | | |
|---|---|---|---|
| 3,018,940 | 1/1962 | Deline | 229/123.2 |
| 3,062,426 | 11/1962 | Mason . | |
| 3,187,976 | 6/1965 | Struble | 229/125.32 |
| 3,967,774 | 7/1976 | Querner | 229/123.2 |
| 5,016,753 | 5/1991 | Henderson | 229/23 BT |
| 5,447,225 | 9/1995 | Gunn et al. | 229/125.32 |

FOREIGN PATENT DOCUMENTS

| | | | |
|---|---|---|---|
| 2 713 597 | 6/1995 | France . | |
| 1165488 | 3/1964 | Germany | 229/123.2 |
| 28 05 356 | 8/1979 | Germany . | |
| 39 40 872 | 6/1991 | Germany . | |
| 43 25 429 | 2/1994 | Germany . | |
| 2126199 | 3/1984 | United Kingdom | 229/23 BT |

OTHER PUBLICATIONS

European Search Report dated Apr. 3, 1996.

*Primary Examiner*—Gary E. Elkins
*Attorney, Agent, or Firm*—Arnold, White, & Durkee

[57] ABSTRACT

The subject-matter of the invention is a foldable package, having a bottom part (1) and a top package part (2) which can be separated. These parts each have side walls (3, 4, 5, 6, 7, 8, 9, 10) which are linked to one another in series. Bottom flaps (15, 16, 17, 18) are linked to longitudinal edges of the bottom part (1). Connection flaps (21, 22) are linked to the longitudinal edges (19, 20), located opposite the side walls (3, 4, 7, 9) of the bottom part (1), of at least two bottom flaps (15, 17). The connection flaps releasably connect the bottom flaps (15, 17) to longitudinal edges of the side walls (5, 6) of the top package part (2). The package can be made from a single blank and erected so as to be ready for filling using a conventional erecting machine. To remove the top package part (2), the connections between the bottom flaps (15, 17) and the associated longitudinal edges of the side walls of the to package part (2) are released, and said top part (2) is pulled up out of the bottom part (1).

7 Claims, 2 Drawing Sheets

FOLDABLE PACKAGE

The invention relates to a foldable package having a bottom part and a top package part which can be separated from the bottom part, which parts each have side walls which are linked to one another in series, bottom flaps being arranged on the longitudinal edges of the bottom part.

Articles intended for retail trade are often packaged in foldable packages. During delivery, the packages should provide the articles contained therein with sufficient protection from, in particular, external mechanical influences, and often need to be stackable. On the retailers' shelves, the top package part is then separated from the bottom part; the bottom part, also called an article tray, serves to present the articles to be sold. Separating the top package part from the bottom part should not leave any mechanical damage on the latter, or at most hardly visible mechanical damage, in order not to impair the visual impression of the sales presentation.

A package according to the preamble of the main claim is known from DE-B-39 40 872. The side walls of the bottom part have attachment flaps which are glued to the side walls of the top package part and thus form the connection between the bottom part and the top package part. To separate the top package part, perforation connections between the attachment flaps and the side walls of the bottom part are released, subsequently the top package part with the attachment flaps adhering to it is lifted off from the bottom part.

A disadvantage in this known package is the comparatively complex manufacture. The bottom part and top package part have to be produced as separate blanks and glued to one another in a separate step. Moreover, after separating the perforation connections between the attachment flaps and the side walls of the bottom part and removing the top package part, U-shaped cutouts remain in the side walls of the bottom part in the regions of the separated attachment flaps, which cutouts impair the esthetic impression of the bottom part as a sales package intended for presentation of the articles.

The invention is based on the object of providing a foldable package of the type mentioned at the beginning, which can be manufactured and erected in a simple manner, and in which the top package part can be separated from the bottom part without visual impairment of the latter.

The object of the invention is achieved in that connection flaps are linked to the longitudinal edges, located opposite the side walls of the bottom part, of at least two bottom flaps, which connection flaps releasably connect the said bottom flaps to longitudinal edges of the side walls of the top package part.

Within the scope of the invention, the term "longitudinal edges" denotes those edges of the flaps or side walls which extend essentially perpendicular to the fold lines which connect the adjacent side walls (longitudinal side walls and end side walls) to one another. The longitudinal edges of the side walls are thus those edges which, in the erected state of the package ready for use, point upward and downward. The longitudinal edges of the bottom flaps are those edges which are connected to the longitudinal edges of the side walls of the bottom part or are located opposite the latter.

The releasable connection between the bottom part and the top package part is formed by means of the connection flaps. The connections between the connection flaps and the associated side walls of the top package part are preferably releasable in the region of the longitudinal edges of the side walls of the top package part. These releasable connections are expediently perforated portions; a particularly preferred option is a tear-off strip which, when it is torn off, allows the connection between the side wall and the connection flap to be released.

To erect the package according to the invention, starting from the flat state of the blank the top package part is folded over together with the connection flaps along the fold line running between the connection flaps and bottom flaps of the bottom part and is placed on the bottom part. The transverse extents of the connection flaps (perpendicular to their longitudinal edges) preferably correspond to the transverse extents of the bottom flaps connected thereto, so that, after this folding-over, the bottom longitudinal edges of the side walls of the top package part terminate flush with the corresponding longitudinal edges of the side walls of the bottom part. The connection flaps now lie above the associated bottom flaps.

Subsequently, the package is erected and glued in a conventional manner explained in more detail below. In the erected state, the connection flaps lie above the bottom flaps, form part of the package bottom and reinforce the latter.

If the package bottom is to have a high load-bearing capacity, it may be expedient for the longitudinal extent of each connection flap to correspond to the longitudinal extent of the bottom flap connected thereto since, in this way, the entire surface of the package bottom is reinforced by the connection flaps. In this case, the connection between the side walls of the top package part and the connection flaps expediently extends only over part of the longitudinal extent of each connection flap; in the other length portions there is no connection. This restriction of the connection to a specific length portion facilitates the subsequent release of this connection for the purpose of separating the top package part.

It is expedient for lid flaps to be linked additionally to the aide walls of the top package part, which lid flaps are folded to form a lid in a conventional manner when the package is closed.

In a particularly advantageous embodiment of the invention, the bottom part and the top package part are integrally connected to one another, that is to say consist of a single common blank. The releasable connection between the side walls of the top package part and the connection flaps is then generally designed as a perforation.

An advantageous material for the package according to the invention is corrugated cardboard.

An embodiment is described below with reference to the drawings, in which.

Figure 1:
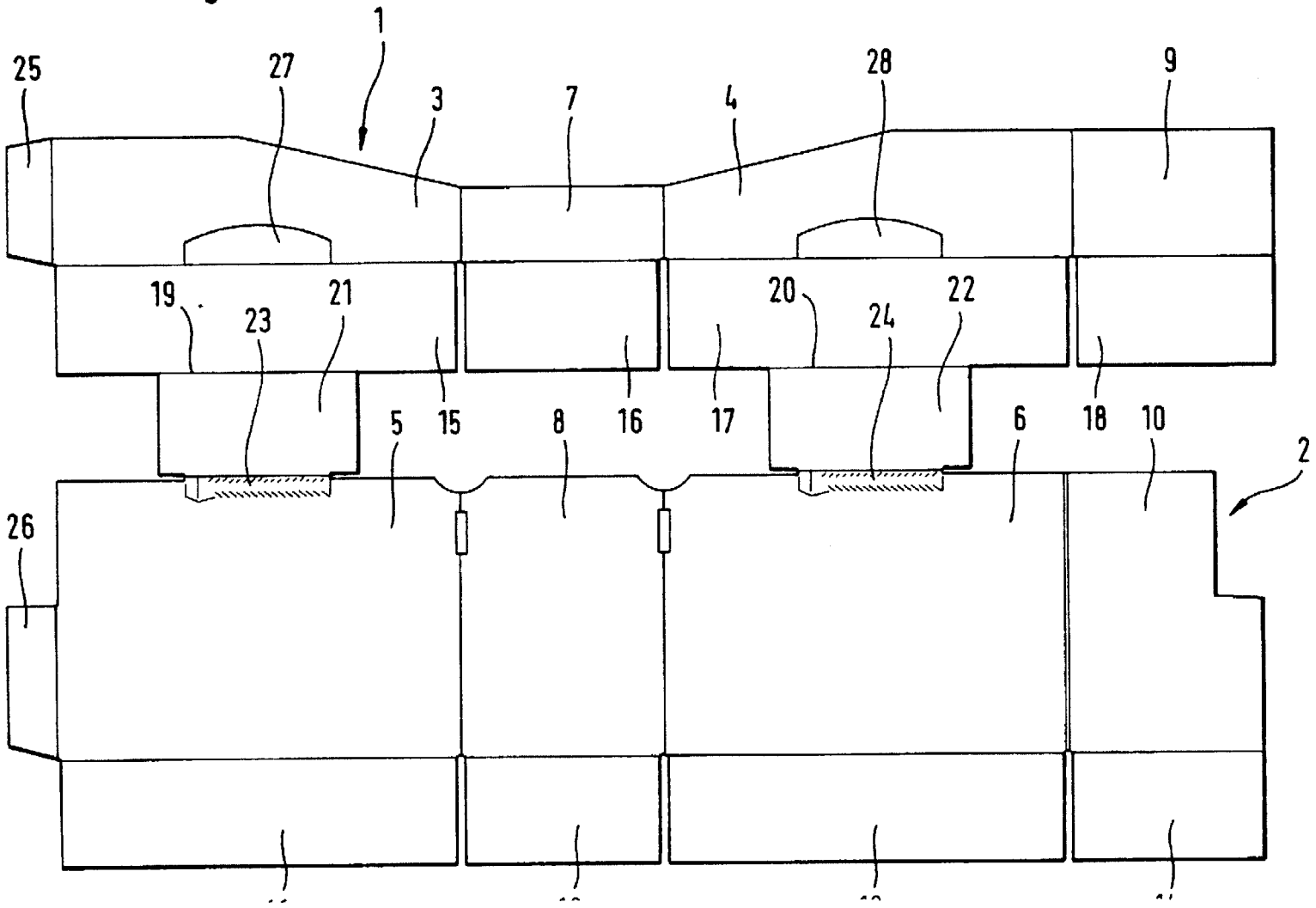
FIG. 1 shows a blank of a package according to the invention.

The package according to the invention basically has a bottom part 1 (article tray) and a top package part 2 (hood). Each of these parts has longitudinal side walls 3, 4, 5, 6 and end side walls 7, 8, 9, 10. The transverse edges of these side walls adjoining one another are connected to one another via fold lines or creases. Arranged on the top longitudinal edges of the hood side walls 5, 6, 8, 10, in the folded and erected state of the package, are lid flaps 11, 12, 13, 14 with which the erected package can be closed in a known manner.

Arranged on the bottom longitudinal edges of the side walls 3, 7, 4, 9 of the bottom part 1, in the erected state, are bottom flaps 15, 16, 17, 18 which form the bottom of the package. The longitudinal edges 19, 20 of the bottom flaps 15, 17 belonging to the longitudinal side walls 3, 4 are connected via fold lines to connection flaps 21, 22 whose diametrically opposite longitudinal edges are connected via perforation connections or tear-off strips 23, 24 to the bottom longitudinal edges of the longitudinal side walls 5 and 6 of the hood 2.

To fold a package according to the invention from the blank shown in FIG. 1, firstly the hood 2 is folded over together with the connection flaps 21, 22 along the fold lines 19, 20 and placed on the bottom part 1. Subsequently, the side walls 3, 7 and 5, 8 are folded over along the fold lines which connect the side walls 7 and 4 and 8 and 6 to one another respectively, so that they come to rest on the side walls 4, 9, 6, 10. The adhesive flaps 25, 26 (also called industrial edges) are glued to the corresponding counter-surfaces of the end side walls 9 and 10. A hot melt adhesive is generally used for this purpose. The box glued in this manner is usually delivered to the customer in the flat state.

Figure 2:
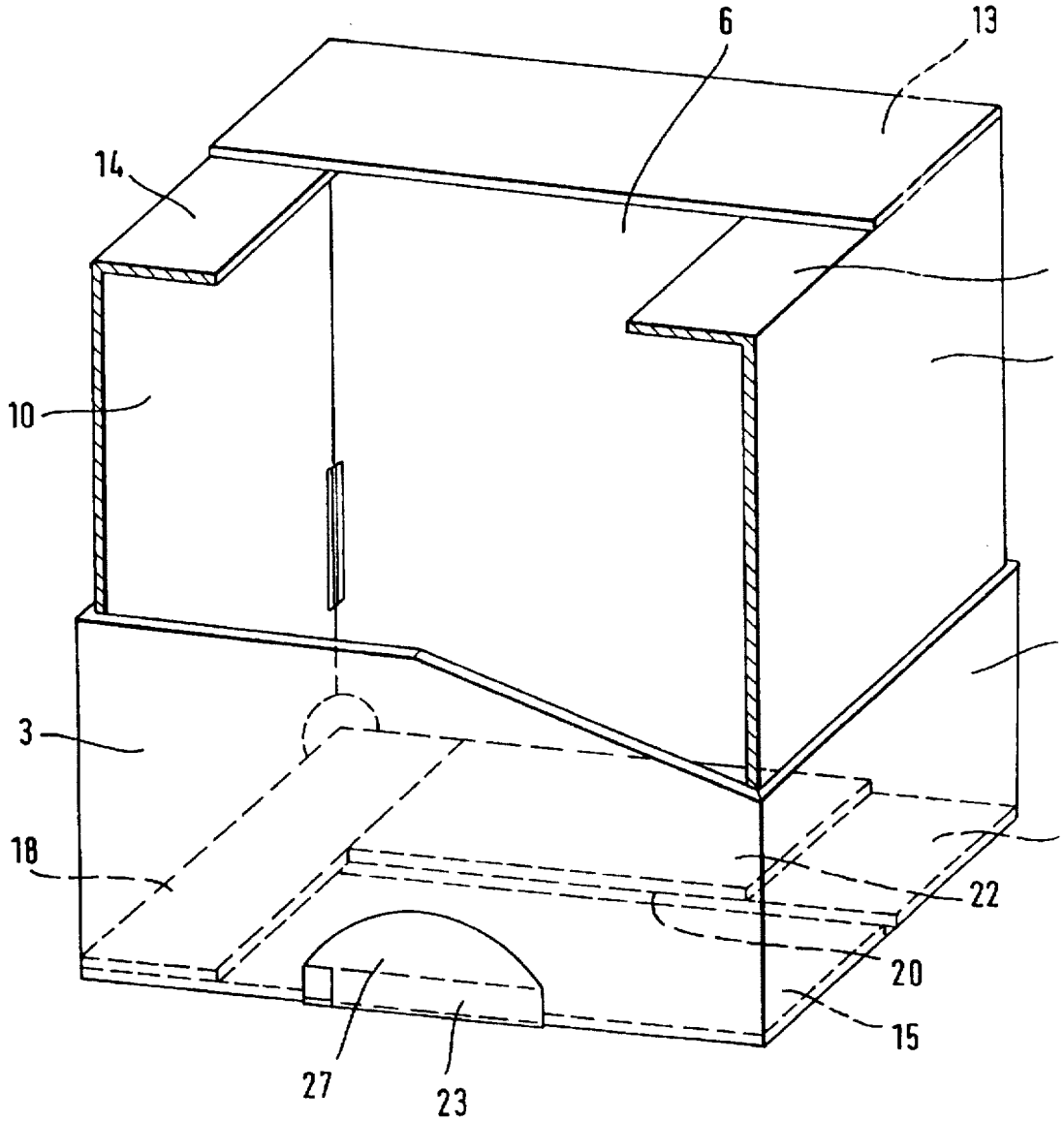
FIG. 2 shows diagrammatically an erected package according to the invention, in a partially sectional illustration.

At the customer's, the package can be erected, filled and closed using conventional erecting and filling machinery. FIG. 2 shows an erected and closed box in a partially sectional view.

It can be seen that the side walls 5, 6, 8, 10 of the hood stand upright with their bottom longitudinal edges on the bottom flaps of the package and can therefore absorb the total forces bearing on the package and can conduct them away into the bottom. If the material of these side walls is sufficiently thick, packages according to the invention can thus be stacked one above the other. The side walls 3, 4, 7, 9 of the bottom part 1 extend on the outside and partially cover the side walls 5, 6, 8, 9 of the hood 2. The arrangement of the connection flap 22 and the bottom flap 17 lying one above the other can also be seen in FIG. 2, which arrangement is produced when the blank shown in FIG. 1 is folded over along the fold lines 19, 20. The connection flap 22 and the connection flap 21 (not illustrated in FIG. 2) thus form a reinforcement of the container bottom located above the bottom flaps 15, 17. The bottom flaps 16, 18 of the end side walls 7, 9 and the connection flaps 21, 22 terminate flush with one another and together form a smooth bottom.

When the package has been arranged on the retailers' sales shelves, the tear-off strips 23, 24, which are provided with zipper-like perforations and connect the longitudinal side walls 5, 6 to the connection flaps 21, 22, are torn off. The tear-off strips 23, 24 are accessible from the outside through cutouts or punch-outs 27, 28 in the longitudinal side walls 3, 4 of the bottom part 1. After these strips 23, 24 have been torn off, the entire hood 2 can be pulled up out of the bottom part 1. The connection flaps 21, 22 remain in the bottom part. Owing to the side walls of the bottom part 1 being lower compared to the side walls of the hood 2, when the hood 2 has been removed the article contained in the package is readily accessible and can be sold out of the bottom part 1. Tearing off the strips 23, 24 does not damage the side walls 3, 4, 7, 9 of the bottom part 1, which means that an attractive sales presentation is possible.

I claim:

1. A foldable package, having a bottom part (1) and a top package part (2) which can be separated from the bottom part, the top part and the bottom part each have side walls (3, 4, 5, 6, 7, 8, 9, 10) which are linked to one another in series, bottom flaps (15, 16, 17, 18) being linked to longitudinal edges of the bottom part (1), wherein connection flaps (21, 22) are linked longitudinal edges (19, 20), located opposite the side walls (3, 4, 7, 9) of the bottom part (1), of at least two bottom flaps (15, 17), wherein the connection flaps releasably connect said bottom flaps (15, 17) to longitudinal edges of the side walls (5, 6) of the top package part (2).

2. The package as claimed in claim 1, wherein releasable connections between the connection flaps (21, 22) and the associated side walls (5, 6) of the top package part (2) are formed by perforated portions (23, 24).

3. The package as claimed in claim 2, wherein the perforated portions (23, 24) are accessible, in an erected state of the package, through cutouts (25, 26) in the side walls (3, 4) of the bottom part (1).

4. The package as claimed in any one of claims 1 to 3, wherein a longitudinal extent of each connection flap (21, 22) corresponds to a longitudinal extent of the connected bottom flap (15, 17).

5. The package as claimed in any one of claims 1 to 3 wherein lid flaps (11, 12, 13, 14) are additionally linked to the side walls (5, 6, 8, 10) of the top package part (2).

6. The package as claimed in any one of claims 1 to 3 wherein the bottom part (1) and the top package part (2) are integrally connected to one another.

7. The package as claimed in any one of claims 1 to 3, wherein they consist of corrugated cardboard.

* * * * *